US008894307B2

(12) United States Patent
Handa

(10) Patent No.: US 8,894,307 B2
(45) Date of Patent: Nov. 25, 2014

(54) PRINTING APPARATUS, PRINTING METHOD AND COMPUTER READABLE RECORDING MEDIUM STORING CONTROL PROGRAM FOR PRINTING APPARATUS

(71) Applicant: Casio Computer Co., Ltd., Tokyo (JP)

(72) Inventor: Yuji Handa, Tachikawa (JP)

(73) Assignee: Casio Computer Co., Ltd., Tokyo (JP)

( * ) Notice: Subject to any disclaimer, the term of this patent is extended or adjusted under 35 U.S.C. 154(b) by 128 days.

(21) Appl. No.: 13/629,458

(22) Filed: Sep. 27, 2012

(65) Prior Publication Data

US 2013/0078024 A1 Mar. 28, 2013

(30) Foreign Application Priority Data

Sep. 28, 2011 (JP) ..... 2011-211882

(51) Int. Cl.

| | |
|---|---|
| ***B41J 11/66*** | (2006.01) |
| ***B41J 2/32*** | (2006.01) |
| ***B41J 11/42*** | (2006.01) |
| ***B41J 3/407*** | (2006.01) |

(52) U.S. Cl.

CPC .. *B41J 2/32* (2013.01); *B41J 11/42* (2013.01); *B41J 3/4075* (2013.01)

USPC ..... 400/621

(58) Field of Classification Search

CPC ..... B41J 11/66; B41J 11/70

USPC ..... 400/621

See application file for complete search history.

(56) References Cited

U.S. PATENT DOCUMENTS

| | | | | | |
|---|---|---|---|---|---|
| 4,967,285 | A | * | 10/1990 | Tabuchi | 358/304 |
| 5,188,470 | A | * | 2/1993 | Matsubara et al. | 400/621 |
| 5,222,818 | A | * | 6/1993 | Akiyama et al. | 400/61 |
| 5,934,812 | A | * | 8/1999 | Nunokawa et al. | 400/621 |
| 6,129,466 | A | * | 10/2000 | Suzuki | 400/615.2 |
| 2002/0067943 | A1 | * | 6/2002 | Furuya et al. | 400/621 |
| 2004/0211521 | A1 | | 10/2004 | Miyasaka | |

FOREIGN PATENT DOCUMENTS

| | | | | | |
|---|---|---|---|---|---|
| JP | 01-230199 | A | | 9/1989 | |
| JP | 05-008475 | A | | 1/1993 | |
| JP | 07-205529 | A | | 8/1995 | |
| JP | 11277821 | A | * | 10/1999 | B41J 11/66 |
| JP | 2000-006472 | A | | 1/2000 | |
| JP | 2001001424 | A | * | 1/2001 | B41J 11/66 |

OTHER PUBLICATIONS

Chinese Office Action dated May 20, 2014 in counterpart Chinese Application No. 201210363914.5.

* cited by examiner

*Primary Examiner* — Nguyen Ha

(74) *Attorney, Agent, or Firm* — Holtz, Holtz, Goodman & Chick PC

(57) ABSTRACT

There is provided a printing apparatus, including a printing head that prints on a tape, a roller that conveys the tape, and a control circuit that inquires of the user whether or not second printing contents are printed on the tape continuously without any interruption after the printing device is caused to print first printing contents on the tape.

11 Claims, 7 Drawing Sheets

PRINTING APPARATUS, PRINTING METHOD AND COMPUTER READABLE RECORDING MEDIUM STORING CONTROL PROGRAM FOR PRINTING APPARATUS

CROSS-REFERENCE TO RELATED APPLICATION

This application is based upon and claims the benefit of priority under 35 USC 119 of Japanese Patent Application No. 2011-211882 filed on Sep. 28, 2011, the contents of which, including the description, claims, drawings and abstract, are incorporated herein by reference.

BACKGROUND OF THE INVENTION

1. Field of the Invention

The present invention relates to a printing apparatus, a printing method for the printing apparatus and a computer readable recording medium that stores a control program for this printing apparatus.

2. Description of the Related Art

There is a printing apparatus as an apparatus for preparing a specific label by setting a cassette which accommodates a tape member in the apparatus and printing arbitrarily characters that are inputted from an inputting device such as a keyboard or that are outputted from other equipment on a print receiving tape of the tape member.

For example, as described in Japanese Unexamined Patent Application No. 7-205529, as this type of printing apparatus, there is a printing apparatus for preparing an appropriate label by printing a mark or the like in a tape blank space that is generated over a distance defined between a printing mechanism and a tape cutting mechanism. In this disclosed printing apparatus, text data is deployed as an image and a mark that is set in advance is also deployed as an image for storage in an image buffer of an RAM. Then, the text data stored in the image buffer is printed by a thermal head, and the mark is printed on the tape by the time when an end of a series of character strings that are successively printed passes a cutter mechanism, thereby making it possible to make effective use of the blank space on the tape by printing the mark on a rear blank space that would otherwise be wasted originally.

In the printing apparatus, however, a process of determining whether or not the label printing continues after the label printing is completed is not executed. In a general printing apparatus, in order to ensure an appropriate amount of rear blank space, after the printing of a label is completed, a process of feeding a print receiving tape without printing or idly is executed, and following this, the print receiving tape is fed idly by a distance defined between a thermal head and a cutter mechanism, the print receiving tape being then cut.

When continuing printing a label, the print receiving tape is not necessarily cut at the completion of the previous printing and the label printing may continue. However, in the printing apparatus described above, since the process of determining whether or not the label printing continues without any interruption is not executed after the completion of the label printing, there is caused a problem that the print receiving tape is consumed wastefully by such an extent that the print receiving tape is fed idly by the distance defined between the thermal head and the cutter mechanism.

BRIEF DESCRIPTION OF THE INVENTION

Then, according to an aspect of the invention, there is provided a printing apparatus, comprising:

a printing head which prints on a tape;

a roller which conveys the tape; and a control circuit which inquires of the user whether or not second printing contents should be printed on the tape continuously without any interruption after the printing head prints first printing contents on the tape.

According to another aspect of the invention, there is provided a printing method executed by a printing apparatus, comprising:

executing a printing process of printing on a tape and a conveying process of conveying the tape; and executing a process of inquiring of a user whether or not second printing contents should be printed on the tape continuously without any interruption after first printing contents are printed on the tape in the printing process.

According to a further aspect of the invention, there is provided a computer readable recording medium which records a program for realizing a printing method, storing a control program which makes a printing apparatus including a printing head which prints on a tape and a roller which conveys the tape:

execute a printing process of printing on the tape and a conveying process of conveying the tape; and execute a process of inquiring of a user whether or not second printing contents should be printed on the tape continuously without any interruption after first printing contents are printed on the tape in the printing process.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate an embodiment of the invention, and together with the general description given above and the detailed description of the embodiment given below, serve to explain the principles of the invention.

DETAILED DESCRIPTION OF THE INVENTION

Figure 1:
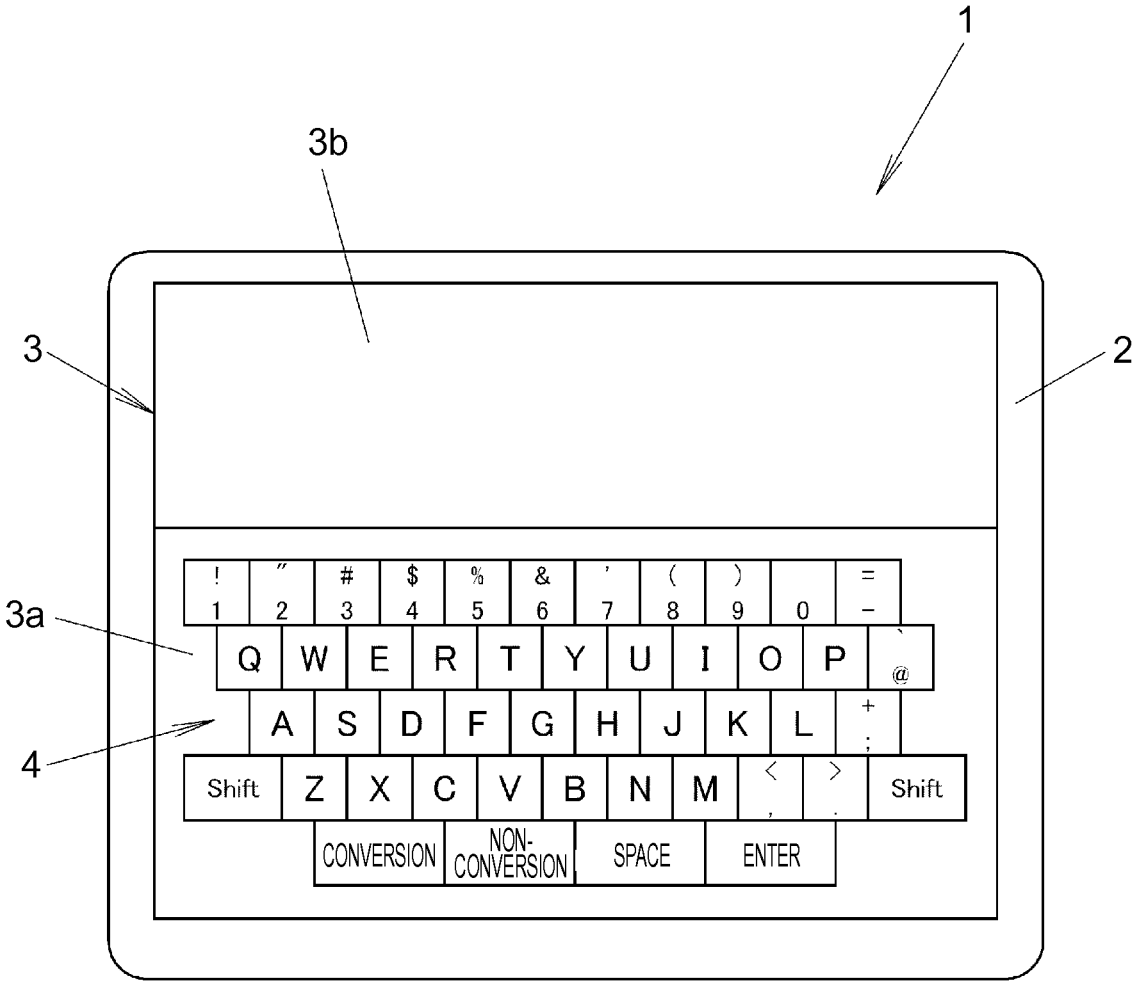
FIG. 1 is a plan view of a printing apparatus according to an embodiment of the invention.
Figure 2:
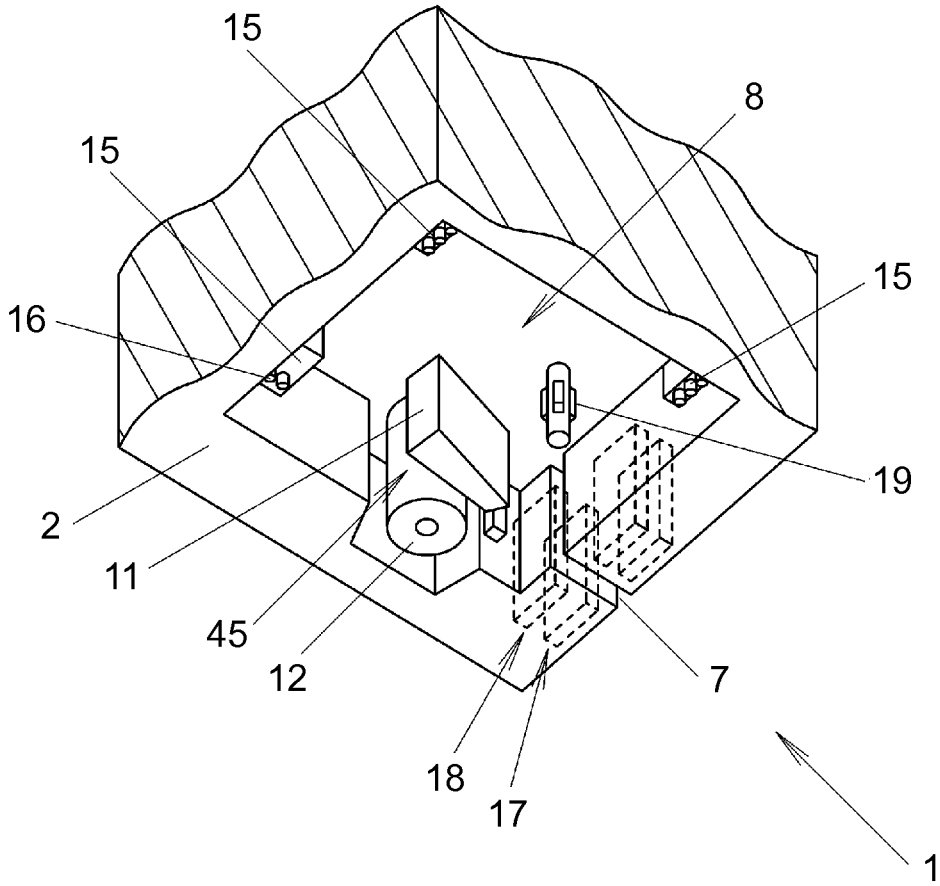
FIG. 2 shows an enlarged view of an interior of the printing apparatus according to the embodiment of the invention and a perspective view of a tape cassette.
Figure 2:
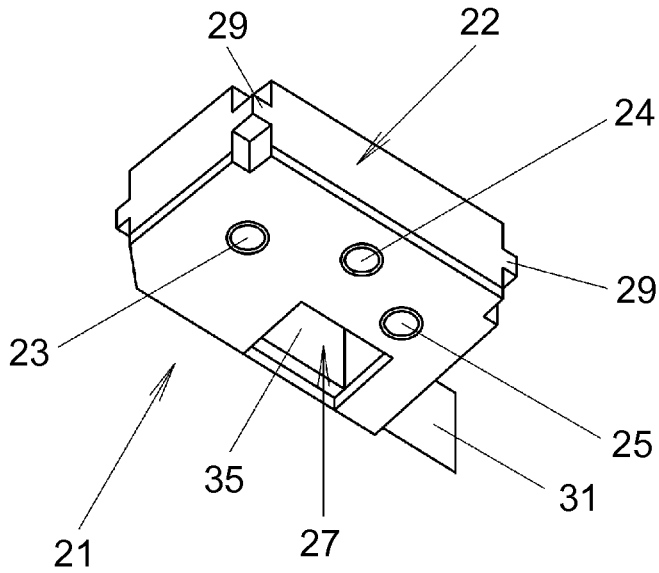

Hereinafter, an embodiment of the invention will be described in detail based on the drawings. FIG. 1 is a plan view of a printing apparatus 1 according to an embodiment of the invention. FIG. 2 shows perspective views showing an external appearance of a tape cassette 21 used in the printing apparatus 1 and a part of an internal construction of the printing apparatus 1. The printing apparatus 1 is an apparatus that prints characters or the like on a print receiving tape which is made up of a tape member 31 formed by laminating a print receiving tape layer that includes a print receiving surface on a front surface and of which a rear surface is made into an adhesive surface and a release tape layer that is affixed to the adhesive surface one on the other.

Note that the tape member 31 is from time to time made into a print receiving heat-sensitive roll tape that has no release tape layer and which has an adhesive layer on a rear surface thereof.

As shown in FIG. 1, the printing apparatus 1 includes on an upper side of a casing 2 a touch panel display 3 that is made up of a liquid crystal display and which displays an imaginary keyboard by a software keyboard function. Additionally, a touch panel input device 4 is placed on the touch panel display 3 so as to be superposed thereon. Specifically, this touch panel input device 4 functions as a character inputting device and is made up of transparent pressure switches. The touch panel input device 4 is disposed on a display screen of the liquid crystal display.

Then, provided on the display screen of the touch panel display 3 are a keyboard area 3*a* that displays an imaginary keyboard including character/symbol input keys such as alphabetic character keys, number keys and symbol keys (hereinafter, these keys being referred generally as character keys) and control keys such as a conversion key for conversion to kanji, a non-conversion key and an execution key and a character editing area 3*b* that displays characters inputted from the keyboard area 3*a*.

The respective keys of the touch panel input device 4 are displayed in the keyboard area 3*a* in the form of images, and by pressing the positions of the keys that are displayed on the display screen as the touch panel input device 4, data on coordinate positions of the keys so pressed are inputted. The software keyboard is made up of the touch panel display 3 and the touch panel input device 4. Note that in place of the keyboard area 3*a* where the imaginary keyboard is displayed, a hardware keyboard may be provided.

As shown in FIG. 2, a cassette loading portion 8 is formed inside an opening/closing lid that is prepared on a back side of the printing apparatus for loading a tape cassette 21. This tape cassette 21 accommodates the tape member 31 and an ink ribbon 35. A tape printing mechanism 45 and cassette receiving portions 15 are formed in the cassette loading portion 8, and the cassette receiving portions 15 support the tape cassette 21 in a predetermined position.

The tape printing mechanism 45 includes a thermal head 11 which is a printing head having printing elements (not shown) that are arranged in a vertical direction, a platen roller 12 that holds the tape member 31 and the ink ribbon 35 between the thermal head 11 and itself to convey them and a ribbon take-up shaft 19 that takes up the ink ribbon 35 that has been used for printing into the tape cassette 21.

Additionally, a tape feed-out portion 7 that communicates with the outside of the casing 2 is formed in one end portion of the cassette loading portion 8. A full cutting mechanism 17 as a full cutting device for cutting the print receiving tape layer and the release tape layer of the tape member 31 in a widthwise direction and a half cutting mechanism 18 as a half cutting device for cutting only the print receiving tape layer of the tape member 31 are incorporated in the tape feed-out portion 7. The tape feed-out portion 7 communicates with the outside of the casing 2 at one end portion, and this end portion is a tape exit 71.

Further, the tape cassette 21 includes a cassette case 22, and this cassette case 22 accommodates in an interior thereof a tape core 23 around which the tape member 31 is wound, a ribbon supply core 24 around which the ribbon 35 that has not yet been used is wound and a ribbon take-up core 25 that takes up the ink ribbon 35 that has been used. Additionally, a head disposing portion 27 is formed in the cassette case 22 of the tape cassette 21, and when the tape cassette 21 is loaded in the cassette loading portion 8, the thermal head 11 is received in this head disposing portion 27.

In addition, engaged portions 29 are formed in corners of the cassette case 22, and these engaged portions 29 are brought into engagement with the cassette receiving portions 15 in the cassette loading portion 8 to thereby be supported by the cassette receiving portions 15. Additionally, although not shown, predetermined irregularities are formed at the engaged portions 29 of the cassette case 22. Irregularities are formed so as to correspond to types of tape cassettes 21. On the other hand, tape width detection switches 16 are formed on the cassette receiving portions 15 in the cassette loading portion 8. The tape width detection switches 16 distinguish between the irregularities formed at the engaged portions 29 of the cassette case 22 when the tape cassette 21 is loaded.

In the printing apparatus 1, when the cassette case 22 is loaded in the cassette loading portion 8, some or all of the engaged portions 29 of the cassette case 22 and the tape width detection switches 16 formed at the cassette receiving portions 15 in the cassette loading portion 8 are brought into engagement with each other. Thus, the tape width detection switches 16 so engaged are pressed. Then, by the combination of the tape width detection switches 16 that are in the ON state, the type of the print receiving tape including its tape width and the like can be identified.

Namely, in this printing apparatus 1, since different types of tape members 31 are incorporated in different cassette cases 21, by distinguishing between the different types of cassette cases 21, for example, widths of the print receiving tapes can be identified, whereby a control unit 40 can prepare printing data that match the widths of the print receiving tapes.

In this printing apparatus, when instructed to start printing, the tape member 31 and the ink ribbon 35 are fed out of the tape cassette 21 and are then sandwiched between the platen roller 12 and the thermal head 11 in such a state that the tape member 31 and the ink ribbon 35 are superposed one on the other for conveyance.

Then, the thermal head 11 is heated and driven based on printing data, and an ink in the ink ribbon 35 is thermally transferred to the print receiving tape of the tape member 31 for printing on the print receiving tape layer. Then, when printing ends, the full cutting mechanism 17 or the half cutting mechanism 16 is set to be actuated, whereby the tape member 31 is cut in the widthwise direction, preparing a label in the form of a tape.

Figure 3:
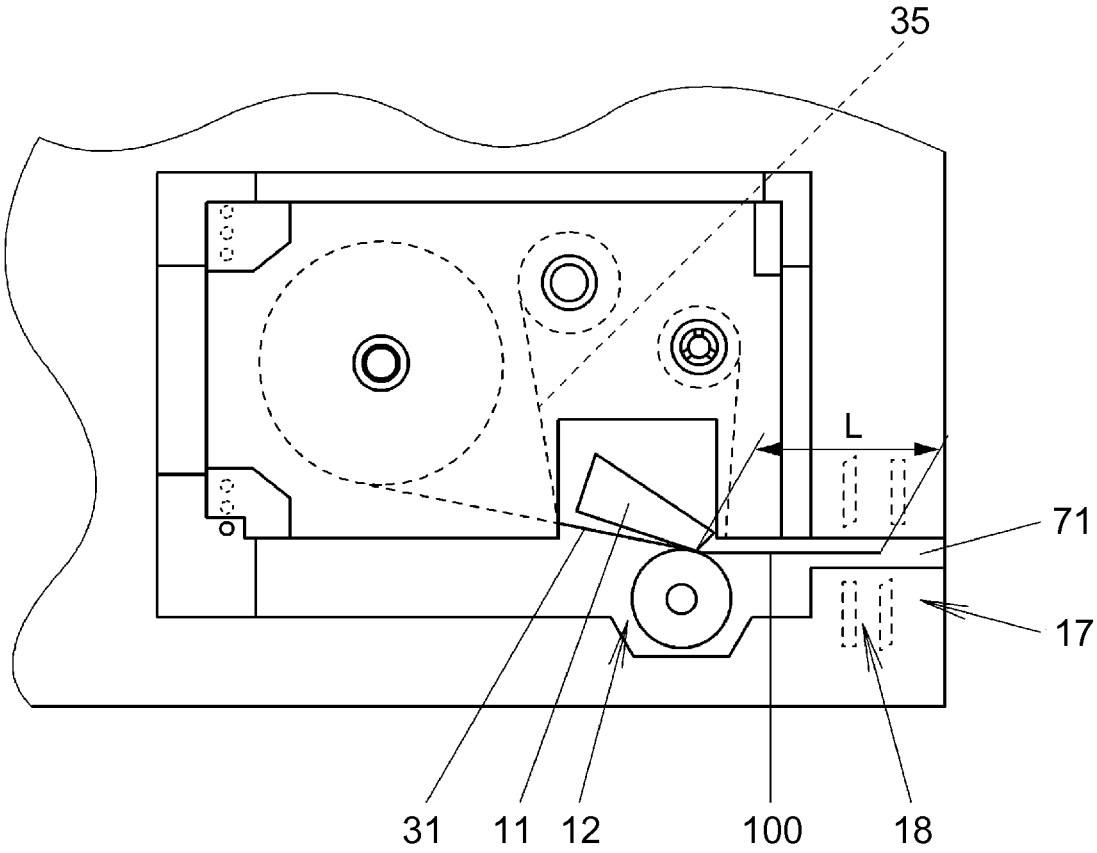
FIG. 3 is an exemplary view showing a state in which a replaceable tape cassette is incorporated in the printing apparatus according to the embodiment of the invention.

The fact that in preparing a label by the printing apparatus 1, a blank space is generated on the printing tape every time a label is prepared will be described by reference to the drawing. FIG. 3 is an exemplary view showing a state in which a replaceable tape cassette is incorporated in the printing apparatus 1 according to the embodiment of the invention.

In this printing apparatus 1, as shown in FIG. 3, there exists a space between a position where a leading end of the thermal head 11 is brought into abutment with the ink ribbon 35 in printing and a position where a distal end of a cutter of the full cutting mechanism 17 which is a cutting device is brought into abutment with the tape member 31 in cutting the print receiving tape. Because of this, a blank space portion 100 which equals a distance L from a leading end of the print receiving tape that is cut by the full cutting mechanism 17 to the thermal head 11 is produced on the tape member 31.

Figure 4:
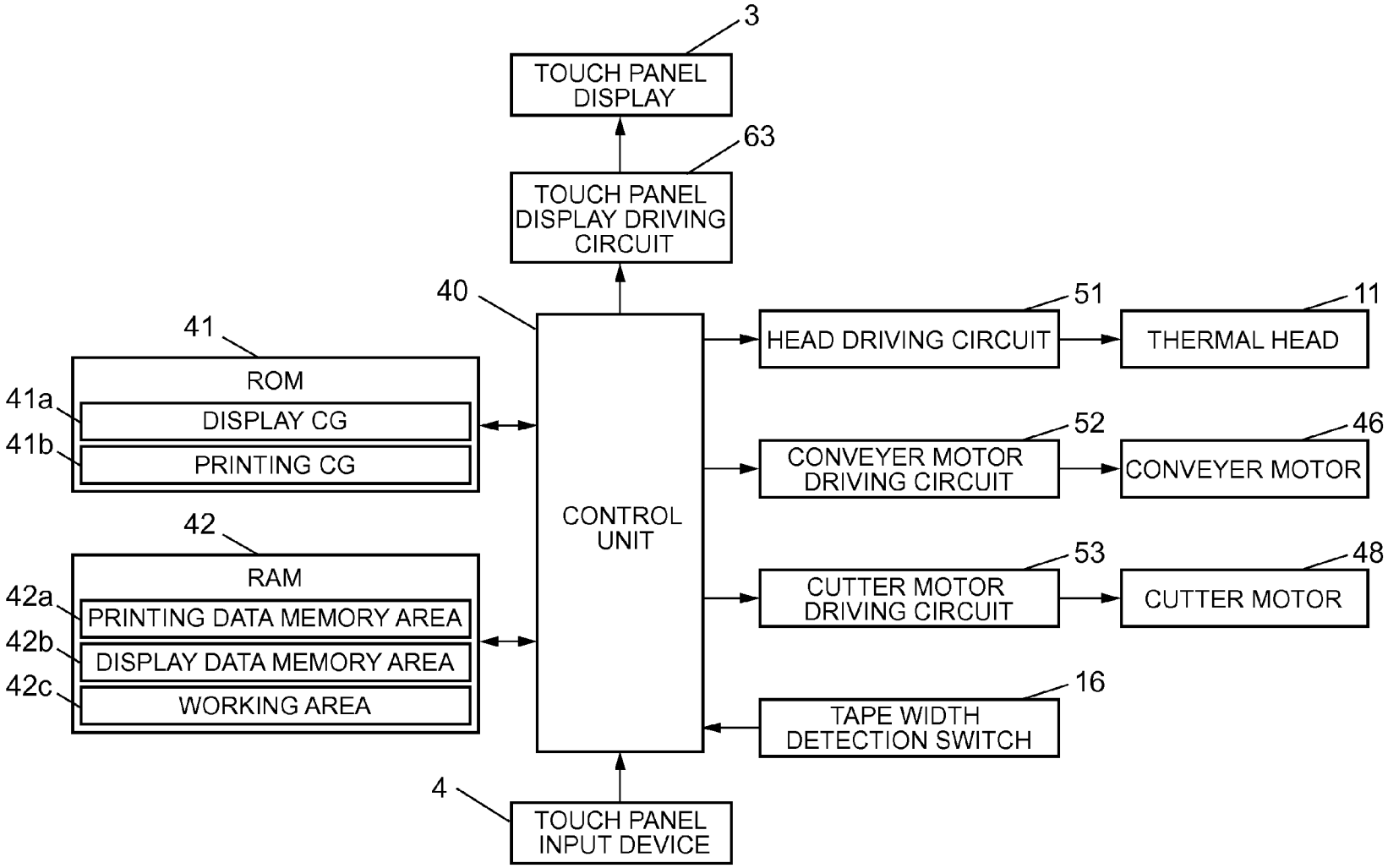
FIG. 4 is a functional block diagram of the printing apparatus according to the embodiment of the invention.

Next, a circuitry configuration of the printing apparatus 1 will be described. As shown in FIG. 4, the printing apparatus 1 includes the control unit 40. A ROM 41 and a RAM 42 are connected to the control unit 40 as storage devices. Additionally, the touch panel input device 4 is connected to the control unit 40 as the inputting device that inputs character data, a font size or the like which results from key operations by the user. Additionally, a touch panel display driving circuit 63 is connected to the control unit 40, and this touch panel display driving circuit 63 drives the touch panel display 3 which is the display device that displays various pieces of information including information inputted.

Further, connected to the control unit 40 are a head driving circuit 51 that drives the thermal head 11, a conveyer motor driving circuit 52 that drives a conveyer motor 46 and a cutter motor driving circuit 53 that drives a cutter motor 48.

In addition, the tape width detection switches 16 are connected to the control unit 40, the tape width detection switches 16 being cartridge distinguishing device that distinguishes between types of cartridges.

The control unit 40 is a CPU and actuates a key input signal from the touch panel input device 4 or a system program that is automatically stored in advance in the ROM 41, a control program stored in a memory card and a control program read in from an external device, controlling the respective operations of the circuit devices using the RAM 42 as a working memory.

The ROM 41 stores a program that displays and prints set character string data and printing fonts, oblique lines and meshes for use in shading or painting out, and dot patterns. Thus, the ROM 41 also functions as a recording medium that stores programs that can be read by the control unit 40.

Additionally, the ROM 41 has a display CG (character generator) 41*a* that stores pattern data of display fonts. Additionally, the ROM 41 has a printing CG (character generator) 41*b* that stores printing pattern data.

The RAM 42 ensures a printing data memory area 42*a* that stores printing pattern data in which the inputted printing information is deployed and a display data memory area 42*b* that stores pattern data to be displayed on the touch panel display 3, and a working area 42*c* such as a register that stores temporarily data necessary for a printing process or a counter.

The head driving circuit 51 controls the thermal head 11 which is the printing device according to the printing data and format setting information and causes the thermal head 11 to execute printing on the tape member 31.

The conveyer motor driving circuit 52 is a circuit for driving a conveyer device and controls the conveyer motor 46 which is a stepping motor and the like that rotates the platen roller 12 and the ribbon take-up shaft 19, conveying the tape member 31 and the ink ribbon 35 in a longitudinal direction at a predetermined speed.

The cutter motor driving circuit 53 is a driving circuit for controlling the cutting devices such as the full cutting device and the half cutting device and controls a stepping motor as the cutter motor 48 that is used in the full cutting mechanism 17 and a DC motor as the cutter motor 48 that is used in the half cutting mechanism 18.

Then, the control unit 40 which is the control device controls the head driving circuit 51 which is the printing device, the conveyor motor driving circuit 52 which is the conveyer device and the cutter motor driving circuit 53 which is the cutting device, whereby the printing apparatus 1 can prepare a label by printing a character string on the tape member 31 and cutting the tape member 31.

Figure 5:
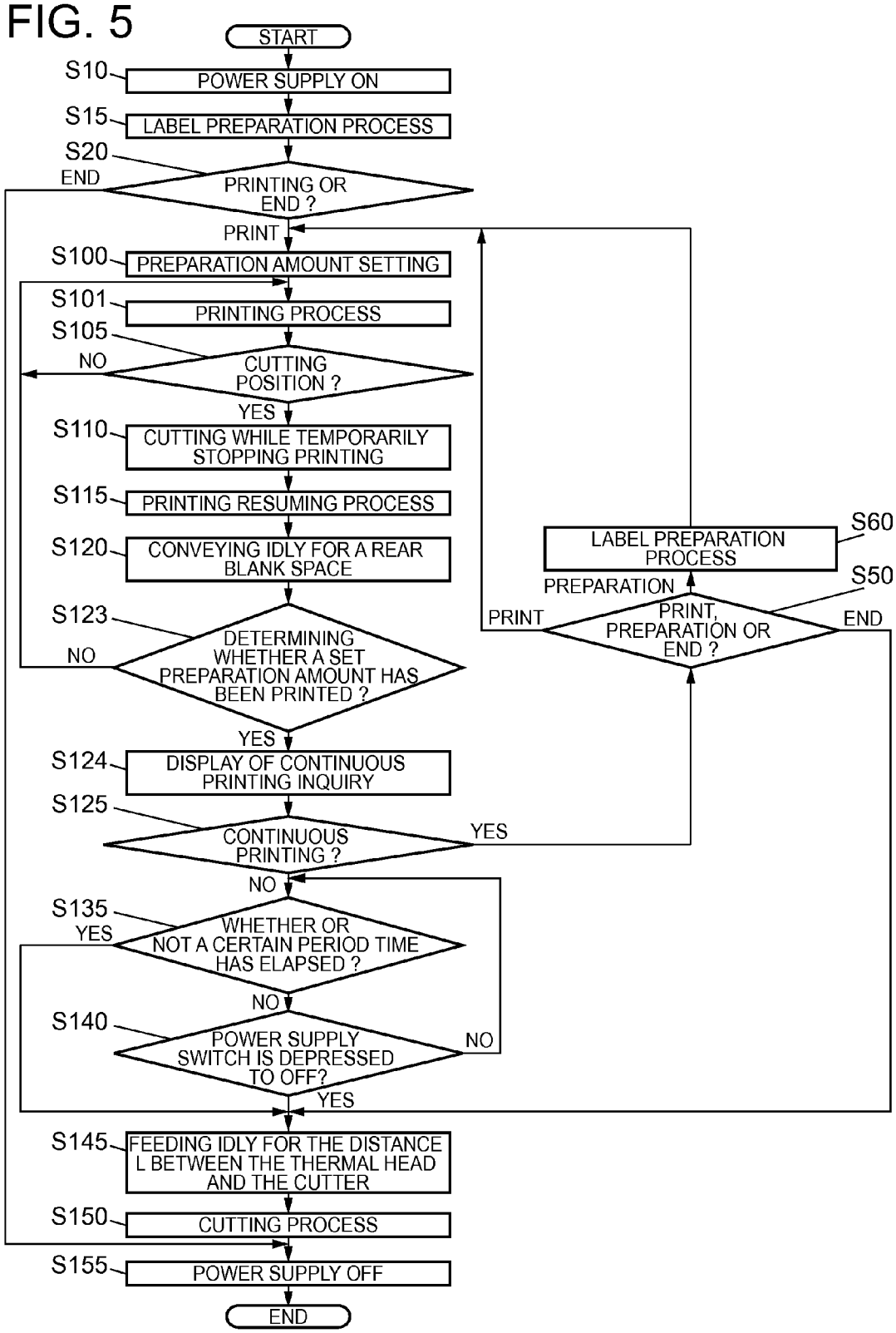
FIG. 5 is a flowchart showing a flow of printing of the printing apparatus according to the embodiment of the invention.
Figure 6:
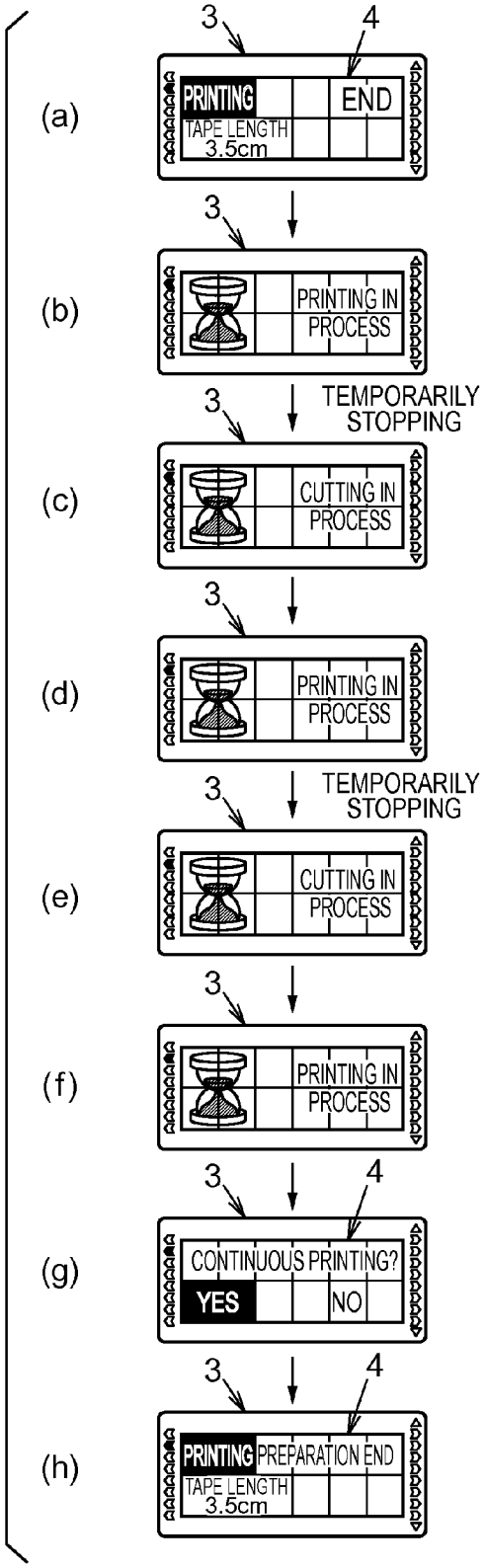
FIG. 6 (*a*) to (*h*) show diagrams showing display examples of a display of the printing apparatus according to the embodiment of the invention.
Figure 7:
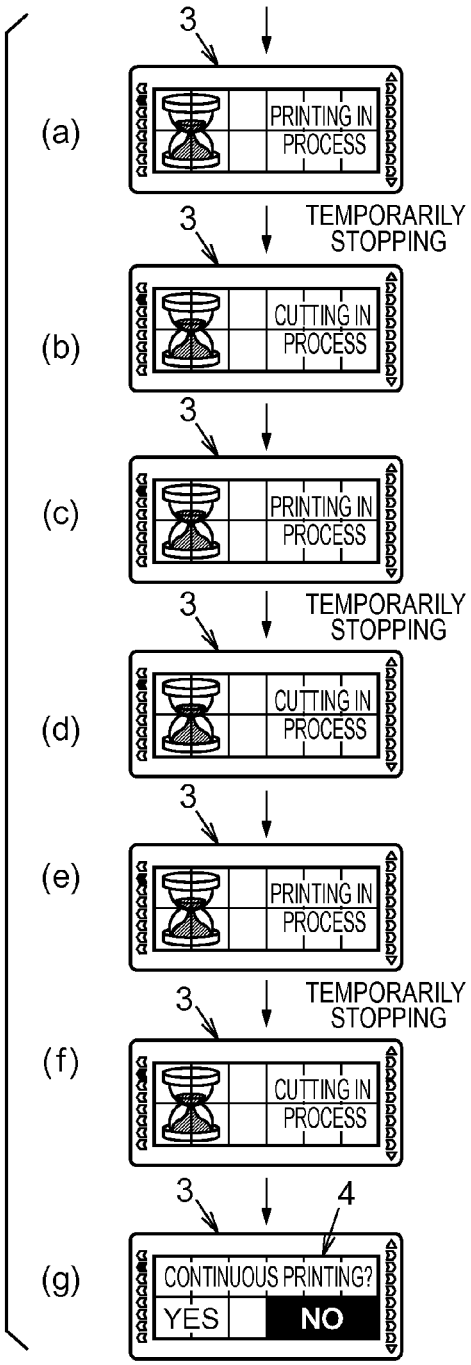
FIG. 7 (*a*) to (*g*) show diagrams showing display examples of the display of the printing apparatus according to the embodiment of the invention.
Figure 8:
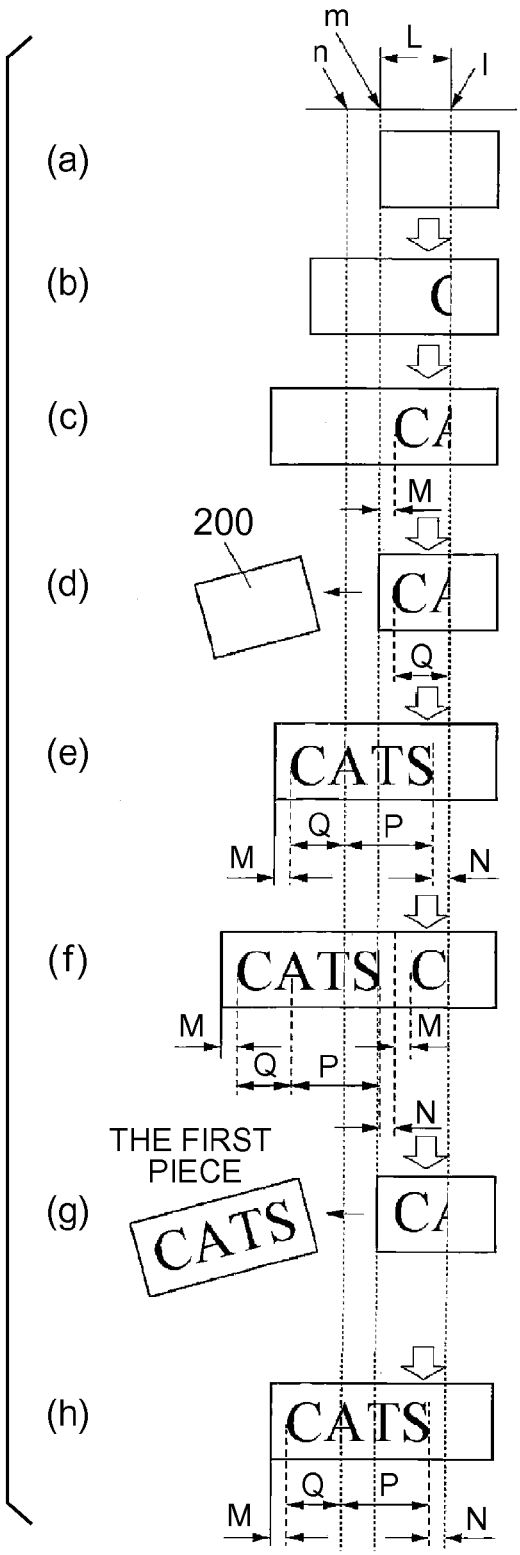
FIG. 8 (*a*) to (*h*) show diagrams showing printing, conveying and cutting positions of a print receiving tape in the printing apparatus according to the embodiment of the invention.
Figure 9:
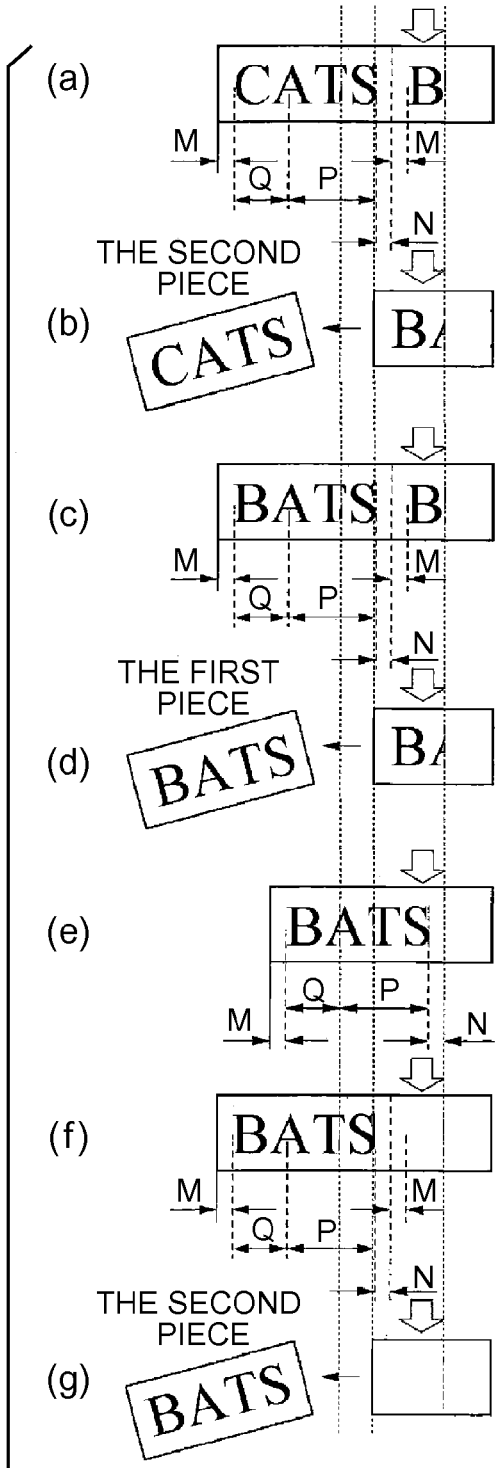
FIG. 9 (*a*) to (*g*) show diagrams showing printing, conveying and cutting positions of the print receiving tape of the printing apparatus according to the embodiment of the invention.

Next, a flow of preparing a label by use of the printing apparatus 1 of the embodiment will be described by reference to the drawings. FIG. 5 is a flowchart showing a flow of preparing a label by the printing apparatus 1. FIGS. 6 and 7 show display examples on the touch panel display 3 when the printing apparatus 1 of the embodiment performs the printing operation. FIGS. 8 and 9 are diagrams showing flows of a conveying process of conveying the print receiving tape, a printing process of printing on the print receiving tape and a cutting process of cutting the print receiving tape so printed, when the printing apparatus 1 of the embodiment performs the printing operation.

Firstly, when the user switches on a power supply switch (not shown) of the printing apparatus 1, a power supply ON process (step S10) is executed, whereby a label preparing process in which the user prepares a label (step S15) is executed.

When the user completes the preparation of the label, the control unit 40 performs a printing determination (step S20) by causing the touch panel display 3 to display a message thereon as shown in FIG. 6(*a*), waiting for an input by the user and determining whether the user executes printing or ends the operation based on the input from the user.

In the printing determination (step S20), when the control unit 40 determines based on the input from the user that the user executes printing, the control unit 40 executes a preparation amount setting process (step S100) of causing the touch panel display 3 to display thereon a message that urges the user to set a preparation amount of labels (first and second set values). In this case, the control unit 40 functions as a preparation amount setting device (first and second preparation amount setting circuits). On the other hand, when the control unit 40 determines based on the input from the user that the user does not perform printing and ends the operation, the control unit 40 executes a power supply OFF process (step S155), ending the process.

As has been described before, when the label preparation is initiated, the blank space portion 100 that equals the distance L from the leading end of the tape member 31 to the thermal head 11 is produced by the space produced between the thermal head 11 and a cutter of the full cutting mechanism 17 when the previous label was produced as shown in FIG. 8(*a*). Here, in FIG. 8, reference character 1 denotes a distal end position of the thermal head 11, reference character m denotes a distal end position of the cutter of the full cutting mechanism 17, and reference character n denotes the position of the tape exit 71 (that is, the position of an external surface of the casing 2).

Next, when the preparation amount of labels is set by the user and further, a signal is given that signals the start of printing, as shown in FIG. 6(*b*), the control unit 40 causes a message reading "printing in process" to be displayed on the touch panel display 3.

After having executed a conveying process to provide a predetermined amount of front blank space M at a distal end portion of a label to be prepared next, as shown in FIG. 8(*c*), by controlling the conveyer motor driving circuit 52 which is the conveyer device, the control unit 40 executes a printing process (step S101) of starting printing a front half portion Q of a character string to be printed for the label, which is to be prepared, on the tape member 31 by controlling the conveyer motor driving circuit 51 and the head driving circuit 51 which is the printing device. In a first cycle of printing process shown in FIGS. 8(*a*) to (*h*), the control unit 40 prints first printing contents preset by the user (for example, a character string of "CATS"). The first printing contents may be a character string, a picture, a pattern or a symbol. In this specification, the label prepared in this first cycle of printing process is referred to as a first label.

Next, the control unit 40 executes a conveying process of conveying the tape member 31 and the ink ribbon 35 by controlling the conveyer motor driving circuit 52 and a process of printing the characters on the tape member 31 by controlling the head driving circuit 51. The control unit 40 executes a cutting position determination (step S105) of whether or not a cutting position of the tape member 31 that is in the conveying and printing process has reached the cutting position where the tape member 31 is cut by the full cutting mechanism 17 while executing the conveying process and the printing process.

When it is determined in the cutting position determination (step S105) that the cutting position of the tape member 31, that is, a position on the tape member 31 that lies further forwards by a distance equal to the front blank space M than the printing start position of the first label has reached the cutting position where the tape member 31 is cut by the full cutting mechanism 17, the flow proceeds to a cutting process (step S110), whereas when such a cutting position of the tape member 31 has not yet reached the cutting position where the tape member 31 is cut by the full cutting mechanism 17, the flow returns to the printing process (step S101).

As shown in FIG. 8(*c*), when such a cutting position of the tape member 31 reaches the cutting position where the tape member 31 is cut by the full cutting mechanism 17, the control unit 40 executes a conveyance stopping process of stopping the conveyance of the tape member 31 and the ink ribbon 35 by controlling the conveyer motor driving circuit 52 and a printing stopping process of stopping the printing of characters onto the tape member 31 by controlling the head driving circuit 51.

Then, as shown in FIG. 6(*c*), the control unit 40 causes a message reading "cutting in process" to be displayed on the touch panel display 3 and executes a cutting process (step S110) of causing an automatic cutter to cut the tape member 31 in its cutting position described above by controlling the cutter motor driving circuit 53 as shown in FIG. 8(*d*).

When the cutting process is completed, the control unit 40 executes, as a printing resuming operation which follows the previous printing process that occurred before the cutting process (step S110), a printing resuming process (step S115) of causing the message reading "printing in process" to be displayed on the touch panel display 3 as shown in FIG. 6(*d*) while causing the tape member 31 and the ink ribbon 35 to be conveyed by controlling again the conveyer motor driving circuit 52 and causing a rear half portion P of the character string to be printed on the tape member 31 by controlling the head driving circuit 51.

Following this, when the printing of the first character string for the first label to be prepared is completed by executing the printing resuming process (step S115), the control unit 40 executes an idle feeding process (step S120) of conveying the tape member 31 and the ink ribbon 35 without printing or idly for a rear blank space N for the label that is being prepared as shown in FIG. 8(*e*).

Next, the control unit 40 executes a set preparation amount attainment determination (step S123) of determining whether or not an amount of labels that are prepared in a label continuous preparation mode has reached a "registered" amount.

In the set preparation amount attainment determination (step S123), when it is determined that the amount of labels prepared has not reached the "registered" amount (for example, two labels), the control unit 40 causes the message reading "printing in process" to be displayed on the touch panel display 3 as shown in FIG. 6(*d*) and returns to the printing process (step S101) of printing characters with a front blank space M ensured for preparation of the next label as shown in FIG. 8(*f*).

The control unit 40 repeats the same series of processes as those that have been described above when the flow returns to the printing process (S101). Namely, the control unit 40 executes again the cutting position determination (step S105) of whether or not a cutting position of the tape member 31 that is in the conveying and printing process has reached the cutting position where the tape member 31 is cut by the full cutting mechanism 17 while executing the aforesaid conveying and printing processes.

When the cutting position of the tape member 31 has reached the cutting position where the tape member 31 is cut by the full cutting mechanism 17, the control unit 40 executes again the cutting process (step S110) of causing the automatic cutter to cut the tape member 31 in its cutting position by controlling the cutter motor driving circuit 53 as shown in FIG. 8(*g*) while causing the message reading "cutting in process" to be displayed on the touch panel display 3 as shown in FIG. 6(*e*).

When the cutting process is completed, the control unit 40 executes, as a printing resuming operation which follows the previous printing process that occurred before the cutting process (step S110), a printing resuming process (step S115) of causing the message reading "printing in process" to be displayed on the touch panel display 3 as shown in FIG. 6(*f*) and causing a rear half portion P of the character string to be printed on the tape member 31 as shown in FIG. 8(*h*).

Following this, when the printing of the second label carrying the first character string has been completed, the control unit executes an idle feeding operation (step S120) of feeding the tape member 31 and the ink ribbon 35 without out printing or idly for a rear blank space N for the label being prepared as shown in FIG. 8(*h*).

Next, when the tape member 31 and the ink ribbon 35 are conveyed for the rear blanks space N for the label being prepared, the control unit 40 executes a set preparation amount attainment determination (step S123) of determining whether or not the amount of labels prepared in a label continuous preparation mode has reached the "registered" amount.

When it is determined in the set preparation amount attainment determination (step S123) that the amount of labels prepared has reached the "registered" amount (for example, two labels), the flow proceeds to a continuous printing inquiry displaying process (step S124) to survey the intention of the user to continue the preparation of a label.

As the continuous printing inquiry displaying process (step S124), the control unit 40 firstly stops the conveyance of the tape member 31, then displays a message reading "continuous printing? Yes, No" on the touch panel display 3 as shown in FIG. 6(*g*) and asks the user about his or her intention to continue the printing.

Following the continuous printing inquiry displaying process (step S124), the control unit 40 executes a continuous printing determination (step S125) on whether or not the user operates to show his or her intention to continue the preparation of a label.

When "Yes" in the message shown in FIG. 6(*g*) is selected (step S125: YES), the control unit 40 executes a printing/preparation determination process (step S50).

In the printing/preparation determination process (step S50), displaying a message shown in FIG. 6(*h*) on the touch panel display 3, the control unit 40 executes the printing/preparation determination process of causing the user to select printing again the current label, preparing a new label or ending printing.

If "print" is selected in the printing/preparation determination process (step S50), the control unit 40 executes step S100. If "prepare" is selected, the control unit 40 executes a label preparation process (step S60) of causing the user to prepare a label. Then, when the user completes the preparation of the label, the control unit 40 executes step S100. If "end" is selected, the control unit 40 executes step S145.

To end the label continuous preparation mode, in the idle feeding process (step S145), the control unit 40 executes an idle feeding of the tape member 31 to feed it by an amount equal to a tape portion that corresponds to the blank space portion 100 that extends over the distance L and thereafter executes a cutting process (step S150), ending the process.

Returning to the preparation amount setting process (step S100), the control unit 40 repeats the same processes as those described above. Namely, an amount of labels to be prepared is set by the user. Further, being given a signal to start printing, the control unit 40 causes a message reading "printing in process" to be displayed on the touch panel display 3 as shown in FIG. 7(*a*). Then, as shown in FIG. 9(*a*), the control unit 40 executes a printing process (step S101) of starting printing a front half portion Q of a character string on the tape member 31 for a label to be prepared. In a second cycle of printing process shown in FIGS. 9(*a*) to 9(*g*), the control unit 40 prints second printing contents (for example, a character string reading "BATS") that are set in advance by the user. As with the first printing contents, the second printing contents may be a character string, a picture, a pattern or a symbol. In this specification, the label prepared in the second cycle of printing process is referred to as a second label.

As this occurs, as shown in FIG. 8(*h*), only a rear blank space N is provided further forwards (leftwards in FIG. 8) than the thermal head 11 and between the thermal head 11 and the rear end of the first character string. Namely, when starting the second cycle of printing process, a blank space portion 100 extending over the distance L like the one produced when starting printing the first character string is not produced anywhere lying further forwards than the thermal head 11. Consequently, when executing a printing process of the second character string, the control unit 40 can avoid wasting a tape portion corresponding to the blank space portion 100 extending over the distance L.

Since the second cycle of printing process is the same as the first cycle of printing process, for the sake of simplicity, the description of the second cycle of printing process is omitted as required, and constituent portions of the second cycle of printing process that are different from the first cycle of printing process will be described in detail. Also, in the second cycle of printing process, after the printing of the second label has been completed, a conveying process (step S120) for a rear blank space, a set preparation amount attainment determination (step S123) and a continuous printing inquiry display process (step S124) are sequentially executed.

In a continuous printing determination (step S125), when "No" in a message shown in FIG. 7(*g*) is selected (step S125: NO), the control unit 40 determines whether or not a certain period of time has elapsed in an elapse of time determination (step S135). If it is determined that the certain period of time has not yet elapsed, the control unit 40 determines whether or not the user depressed a power supply switch in a power supply OFF depressing determination (step S140).

If it is determined in step S140 that the user has not switched off the power supply switch, the control unit 40 executes step S135. If it is determined in step S135 that the certain period of time has elapsed or if it is determined in step S140 that the user has switched off the power supply switch, in order to end the label continuous preparation mode, the flow proceeds to the idle feeding process (step S145), where the control unit 40 feeds idly the tape member 31 and the ink ribbon S5. Then, after ending the idle feeding process, the control unit 40 executes a cutting process (step S150).

In the embodiment, after the completion of printing, the control unit 40 executes the continuous printing determination (step S125). If the printing of a label is determined to continue (step S125: YES), the control unit 40 executes the process of printing again the current label (step S100) or the new label preparation process (step S60) without executing the idle feeding process (step S145) of the tape member and the ink ribbon 35. If the printing of a label is determined not to continue (step S125: NO), the control unit 40 executes the idle feeding process (step S145) of the tape member 31 and the ink ribbon 35, ending the process (step S155).

Consequently, since the idle feeding of the tape member 31 and the ink ribbon 35 by the tape portion that corresponds to the blank space portion 100 extending over the distance L is not performed until the control unit 40 executes a power supply OFF process (step S155), the tape member 31 and the ink ribbon 35 can be saved by the tape portion that corresponds to the blank space portion 100 extending over the distance L, compared with the case where the idle feeding of the tape member 31 and the ink ribbon 35 is executed every time printing ends.

While the embodiment has been described as the printing apparatus 1 having the automatic cutter, the embodiment is presented as the example, and hence, there is no intention to limit the spirit and scope of the invention by the embodiment. For example, the embodiment can also be applied to a printing apparatus 1 that has no automatic cutter but has a cutting device such as a manual cutter or a printing apparatus 1 that has neither the automatic cutter nor the manual cutter, causing the user to cut the print receiving tape with a pair of scissors.

In this case, at the point in time when the idle feeding process (step S120) in the embodiment ends, a cutting mark should be printed on the tape member 31 by the thermal head 11. By doing this, the user is allowed to cut the print receiving tape at the cutting mark functioning as a cutting target position with the manual cutter or the pair of scissors, whereby not only can the label with proper blank spaces be prepared, but also the print receiving tape can be saved.

Additionally, in the embodiment, while the continuous printing determination (step S125) is described as being executed after the idle feeding process (step S120), the invention is not limited thereto, and hence, the idle feeding process (step S120) may be executed after the continuous printing determination (step S125). As this occurs, the idle feeding process should be executed after the user's selection is received whether the user selects "Yes" or "No" in the continuous printing determination (step S125).

In addition, in the embodiment, while the user is informed of the inquiry by the control unit 40 causing the inquiry to be displayed on the touch panel display 3, the invention is not limited thereto, and hence, a configuration may be adopted in which the printing apparatus 1 includes a loud speaker (a sound or voice output device) and the control unit 40 causes the speaker to loudly output the contents of the inquiry so that the user is informed thereof.

Thus, according to the embodiment of the invention, it is possible to provide the printing apparatus 1 that can save on the print receiving tape, the printing method of preparing a label in the printing apparatus 1 and the printing control program that realizes the printing method for preparing a label in the printing apparatus 1.

In addition, according to the embodiment of the invention, by setting an amount of labels to be prepared in advance, within the set preparation amount, the print receiving tape can be saved by making effective use of the blank space portions 100 on the print receiving tape in an ensured fashion.

Further, according to the embodiment of the invention, whether or not the preparation of labels continues can be set during the preparation of the last label of the preparation amount of labels that is set in advance, and therefore, even when the amount of labels to be printed is increased, the print receiving tape can be saved.

In addition, according to the embodiment of the invention, by cutting the print receiving tape by omitting a blank space 200 at a leading end of the next label, the printing tape can be saved properly.

Additionally, according to the embodiment of the invention, by cutting the print receiving tape after the print receiving tape has been conveyed to the predetermined location during the preparation of the label, the label can be prepared properly by preventing a printing error.

Further, according to the embodiment of the invention, by printing the cutting position mark on the print receiving tape after the print receiving tape has been conveyed to the predetermined location during the preparation of the label, labels can be printed continuously and be cut with a pair of scissors or the like thereafter, whereby the print receiving tape can be saved.

Further, the processes shown in the flowchart described in the embodiment of the invention can be applied to various types of equipment as a printing control program which a computer is made to execute in such a state that the processes are written in a recording medium such as a magnetic disk, an optical disk and a semiconductor memory, for example. Alternatively, the processes can be applied to various types of equipment by being transmitted by a communication medium. In this way, the respective processes that are described in the embodiment are stored in a desired recording medium and the control program is executed by one other computer. Also, in this case, the same function and advantage can be obtained as those obtained when the printing apparatus 1 of the embodiment is used. Note that the computer is not limited to the computer that is incorporated in the printing apparatus described in the embodiment, and hence, various types of computers are included, provided that they can read the printing control program that is stored in a recording medium and include an arithmetic and logic unit (ALU) such as a CPU that executes the control operations according to the printing control program read thereby.

While the invention has been described based on the specific embodiment, the embodiment is presented as the example, and hence, there is no intention to limit the scope of the invention by the embodiment. This novel embodiment can be carried out in other various forms, and various omissions, replaces or modifications can be made thereto without departing from the spirit and scope of the invention. The embodiment and its modified examples are included in the spirit and scope of the invention and are also included in the scopes of the inventions described in claims and their equivalents.

What is claimed is:

1. A printing apparatus, comprising:

a printing head which prints on a tape;

a roller which conveys the tape; and a control circuit which controls the printing head to print first printing contents on the tape, thereafter controls the roller to feed the tape by an amount corresponding to a rear blank space, and thereafter, before the control circuit controls the roller to feed the tape to a cutting position, transmits an inquiry to a user inquiring whether or not second printing contents are to be prepared;

wherein when the user inputs a response to the inquiry that the second printing contents are to be prepared, the control circuit performs control to accept input from the user to prepare the second printing contents, thereafter controls the roller to feed the tape by an amount corresponding to a front blank space, and thereafter controls the printing head to print the second printing contents on the tape.

2. The printing apparatus according to claim 1, wherein:

the inquiry transmitted to the user inquires as to whether one of (i) the first printing contents are to be printed on the tape again, (ii) the second contents are to be prepared, and (iii) printing is to end; and when the user inputs an answer to the inquiry that the first printing contents are to be printed again, the control circuit controls the roller to feed the tape by the amount corresponding to the front blank space, and thereafter controls the printing head to print the first printing contents on the tape.

3. The printing apparatus according to claim 1, wherein the control circuit causes the roller to feed the tape by the amount corresponding to the rear blank space, and thereafter controls the printing head to print a mark on the tape.

4. The printing apparatus according to claim 1, further comprising one of a display device and a sound or voice output device which transmits the inquiry.

5. The printing apparatus according to claim 2, wherein when the user inputs an answer to the inquiry that the printing is to end, the control circuit controls the roller to feed the tape to a cutting position.

6. The printing apparatus according to claim 5, further comprising:

a cutter for cutting the tape, wherein the control circuit controls the cutter to cut the tape which is fed to the cutting position.

7. The printing apparatus according to claim 1, further comprising a first preparation amount setting circuit which receives from the user a first set value indicating a preparation amount of which the first printing contents are to be printed before the control circuit controls the printing head to print the first printing contents on the tape.

8. The printing apparatus according to claim 7, wherein the control circuit transmits the inquiry after having controlled the printing head to print all of the preparation amount indicated by the first set value.

9. The printing apparatus according to claim 7, further comprising a second preparation amount setting circuit which receives from the user a second set value indicating a preparation amount of which the second printing contents are to be printed before the control circuit controls the printing head to print the second printing contents on the tape.

10. A printing method executed by a printing apparatus, the method comprising:

printing first print contents on a tape;

thereafter, feeding the tape by an amount corresponding to a rear blank space; and thereafter, before feeding the tape to a cutting position, transmitting an inquiry to a user inquiring whether or not second printing contents are to be prepared;

wherein when the user inputs a response to the inquiry that the second printing contents are to be prepared, the method further comprises accepting input from the user to prepare the second printing contents, thereafter feeding the tape by an amount corresponding to a front blank space, and thereafter printing the second printing contents on the tape.

11. A non-transitory computer readable recording medium having a program recorded thereon, the program being executable to control a printing apparatus comprising a printing head which prints on a tape and a roller which conveys the tape to perform functions comprising:

controlling the printing head to print first print contents on a tape;

thereafter, controlling the roller to feed the tape by an amount corresponding to a rear blank space; and thereafter, before controlling the roller to feed the tape to a cutting position, performing control to transmit an inquiry to a user inquiring whether or not second printing contents are to be prepared;

wherein when the user inputs a response to the inquiry that the second printing contents are to be prepared, the printing apparatus is controlled to perform further functions comprising accepting input from the user to prepare the second printing contents, thereafter controlling the roller to feed the tape by an amount corresponding to a front blank space, and thereafter controlling the printing head to print the second printing contents on the tape.

* * * * *